US010947017B2

(12) United States Patent
Wortman et al.

(10) Patent No.: US 10,947,017 B2
(45) Date of Patent: Mar. 16, 2021

(54) BUCKET LID

(71) Applicant: BUCKET BROTHERS LLC, Mansfield, OH (US)

(72) Inventors: Ivan J. Wortman, St. Marys, PA (US); Tyler Seymour, Beavercreek, OH (US); Mitchell W. Cox, Newark, OH (US)

(73) Assignee: BUCKET BROTHERS LLC, Mansfield, OH (US)

( * ) Notice: Subject to any disclaimer, the term of this patent is extended or adjusted under 35 U.S.C. 154(b) by 185 days.

(21) Appl. No.: 16/207,510

(22) Filed: Dec. 3, 2018

(65) Prior Publication Data

US 2019/0168926 A1 Jun. 6, 2019

Related U.S. Application Data

(60) Provisional application No. 62/593,438, filed on Dec. 1, 2017.

(51) Int. Cl.
*B65D 43/02* (2006.01)
*A47C 7/02* (2006.01)
(Continued)

(52) U.S. Cl.
CPC ..... *B65D 43/0208* (2013.01); *A47C 7/02* (2013.01); *A47C 7/626* (2018.08); *B65D 43/0218* (2013.01); *B65D 43/065* (2013.01); *B65D 51/24* (2013.01); *B65D 2251/0003* (2013.01); *B65D 2251/06* (2013.01); *B65D 2251/10* (2013.01); *B65D 2543/00092* (2013.01); *B65D 2543/00231* (2013.01); *B65D 2543/00277* (2013.01); *B65D 2543/00287* (2013.01);
(Continued)

(58) Field of Classification Search
CPC .. B65D 43/0208; B65D 43/065; B65D 51/24; B65D 51/003; B65D 51/06; B65D 51/10
USPC ..... 220/212
See application file for complete search history.

(56) References Cited

U.S. PATENT DOCUMENTS

D980,097 12/1910 Grant
2,346,744 A 4/1944 Glassman
(Continued)

OTHER PUBLICATIONS

H.T. Enterprises "HT Bucket Seat" https://www.amazon.com/H-T-Enterprises%C2%AE-Padded-Bucket-Seat/dp/B0002N26HA; A padded bucket seat that's crescent shaped to access the contents of the bucket.

(Continued)

*Primary Examiner* — King M Chu
(74) *Attorney, Agent, or Firm* — Jacob M. Ward; Ward Law Office LLC

(57) ABSTRACT

A combination bucket lid and seat permits a user to access contents of the bucket while the user is seated. The lid has a lip for engaging the bucket, and an opening configured to receive a hand of a user for removing the bucket contents. The opening may be selectively covered by a door that is attached to the lid. The door is movable between a closed position and an opened position. The door is configured to cover the opening of the lid in the closed position and uncover the opening of the lid in the open position. The door also may have a pad that allows the user to be comfortable while sitting. More specifically, the door may be attached to the lid by a hinge, or rotatable about an axis of rotation, to selectively cover and uncover the opening.

18 Claims, 5 Drawing Sheets

(51) Int. Cl.

| | |
|---|---|
| ***B65D 43/06*** | (2006.01) |
| ***A47C 7/62*** | (2006.01) |
| ***B65D 51/24*** | (2006.01) |

(52) U.S. Cl.
CPC ..... *B65D 2543/00296* (2013.01); *B65D 2543/00379* (2013.01); *B65D 2543/00509* (2013.01); *B65D 2543/00537* (2013.01); *B65D 2543/00555* (2013.01)

(56) References Cited

U.S. PATENT DOCUMENTS

| | | | | |
|---|---|---|---|---|
| 3,206,266 | A | 9/1965 | Holloway et al. | |
| 3,603,019 | A | 9/1971 | Smeltzer | |
| 3,746,391 | A * | 7/1973 | Novak ..... | A47C 3/16 297/188.1 |
| 3,751,845 | A | 8/1973 | Van Leeuwen | |
| 5,429,265 | A | 7/1995 | Maire et al. | |
| 5,586,805 | A * | 12/1996 | Rinehart ..... | A01K 97/22 206/216 |
| D391,717 | S | 3/1998 | Stein | |
| 5,970,651 | A | 10/1999 | Torkilsen et al. | |
| D439,022 | S | 3/2001 | Brandeis | |
| 9,809,376 | B2 | 11/2017 | Mitchell et al. | |
| 2004/0074936 | A1 | 4/2004 | McDonald | |

OTHER PUBLICATIONS

Frabill "Frabill Strato Bucket Seat" https://www.amazon.com/Frabill-1642-Strato-Bucket-Seat/dp/B0002N2FD0/ref=sr_1_fkmrnull_1?keywords=Frabill+Strato+Bucket+Seat&qid=1551716166&s=gateway&sr=8-1-fkmrnull; A padded bucket seat that's has a rounded edge, to allow a user to access the contents of the bucket.

Champion Sports "Champion Sports Ball Bucket" https://www.amazon.com/Champion-Sports-Plastic-Ball-Bucket/dp/B0029VNJ7E/ref=sr_1_3?ie=UTF8&qid=1510435330&sr=8-3&keywords=baseball+bucket+with+padded+lid; Bucket lid with padding for a user to sit on.

* cited by examiner

BUCKET LID

CROSS REFERENCE TO RELATED APPLICATIONS

This application claims the benefit of U.S. Provisional Application No. 62/593,438, filed on Dec. 1, 2017, the entire disclosure of which is hereby incorporated herein by reference.

FIELD

The present disclosure relates to a combination seat and lid and, more specifically, a combination seat and lid for placement a bucket.

BACKGROUND

Buckets are commonly used for recreational purposes. For example, athletes, gardeners, fisherman, hunters, and campers commonly use buckets to carry items such as such as baseballs, spades and planters, bait and fishing tackle, bullets, and food.

Conventional buckets may be five- or six-gallons in volume, and approximately two-feet tall and one-foot in diameter. These buckets are also generally made of plastic and may be provided with an inexpensive wire or plastic handle that pivotally attaches across a top of the bucket. Such buckets can also be provided with molded plastic lids that are selectively snapped on top of the bucket to seal the bucket and secure the contents.

It is known to use these conventional bucket lids as a seat. For example, in baseball, an athlete or coach will often sit on a baseball bucket in the dugout. A gardener may also sit upon the bucket as he or she plants bulbs or pulls weeds. However, there are problems with using conventional bucket lids as a seat. Often, the bucket lid is not padded, and may become uncomfortable to sit on after extended periods of time. Additionally, a person sitting on the bucket lid may not be able to access the contents without standing and removing the lid.

Bucket lids that have a cushion are known in the art. For example, U.S. Pat. No. D439,022 to Brandeis discloses a cushioned bucket lid that has a hinged door and an integral storage area. The Brandeis lid allows a user to open the door and access a storage area of the lid but not an underlying bucket with which the lid is used. In a further example, U.S. Pat. No. 3,751,845 to van Leeuwen, discloses a fishing bucket with a rotatably mounted closure and seat means. The van Leeuwen fishing bucket provides access an integral storage area of the closure and seat means but not access to the underlying bucket while the person is seated.

There is a continuing need for a bucket lid and seat combination that allows a user to access the contents of the bucket while in a seated position. Desirably, the bucket lid and seat combination is padded for the comfort of the user while in the seated position.

SUMMARY

In concordance with the instant disclosure, a bucket lid and seat combination that allows a user to access the contents of the bucket while in a seated position, and which is padded for the comfort of the user while in the seat position, has been surprisingly discovered.

In a first embodiment, a combination seat and bucket lid has a main body with an opening formed therein. A door is selectively attached to the main body. The door has a first pad. The door is movable between an opened position and a closed position. The door covers the opening where the door is in the closed position. The door is disposed between the first pad and the main body where the door is in the opened position.

In another embodiment, a combination seat and bucket lid has a main body with an opening formed therein. A door is hingedly attached to the main body. The door has a first side and a second side. Attached to the first side of the door is a first pad. The door is selectively movable between an opened position and a closed position. The door covers the opening of the main body in the closed position. The first pad is disposed within the opening, where the door is in the closed position. The door is disposed between the first pad and the main body where the door is in the opened position.

In a further embodiment, a combination seat and bucket lid has a main body with an opening formed therein. A door is movably attached to the main body and selectively rotatable about an axis of rotation that is transverse to the main body. The door has a first side and a second side. A first pad is disposed on the second side of the door. The door is movable between an opened position and a closed position. The door covers the opening of the main body in the closed position, and the first pad is not disposed within the opening where the door is in the closed position. The door is disposed between the first pad and the main body where the door is in the opened position and in the closed position. The door is also disposed entirely within the lip of the lid where the door is in the closed position. However, a portion of the door is disposed outside of the lip where the door is in the opened position.

DRAWINGS

The above, as well as other advantages of the present disclosure, will become clear to those skilled in the art from the following detailed description, particularly when considered in the light of the drawings described hereafter.

Figure 5:
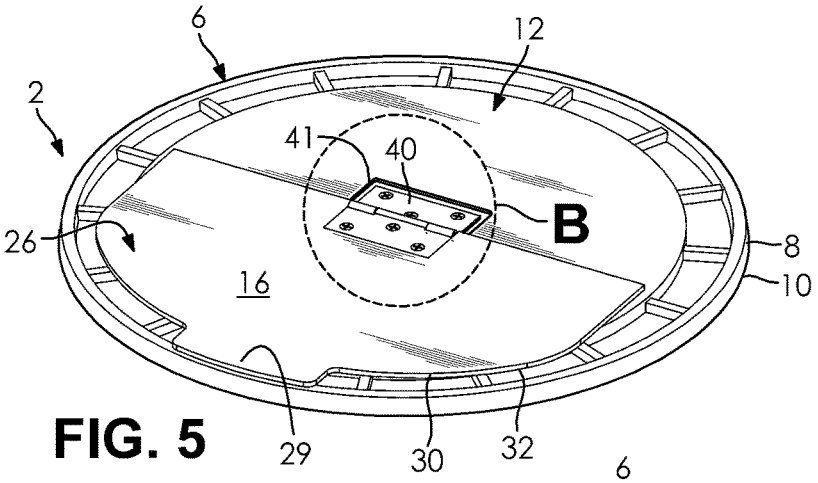
FIG. 5 is a top perspective view of a lid according to another embodiment of the present disclosure, and further showing a movable door attached to the lid with a butterfly hinge and in a closed position covering an opening of the lid.
Figure 7:
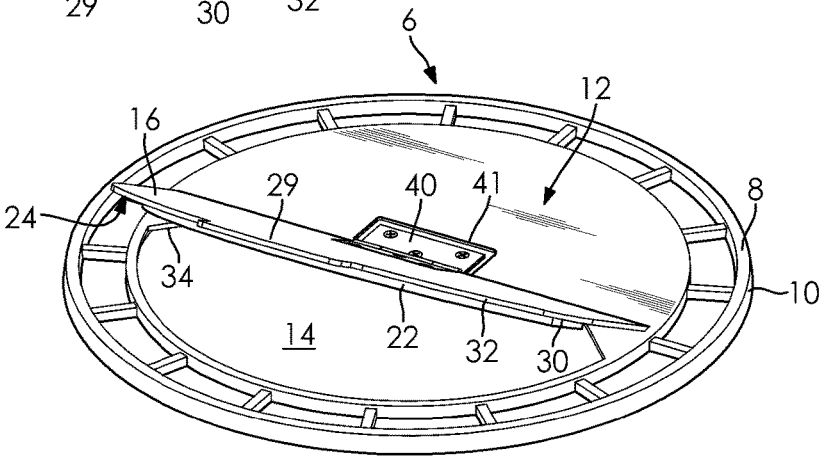
Figure 8:
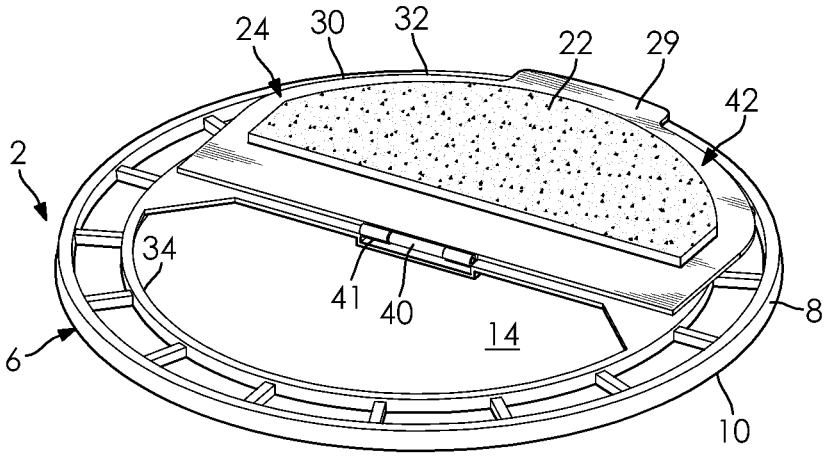
Figure 9:
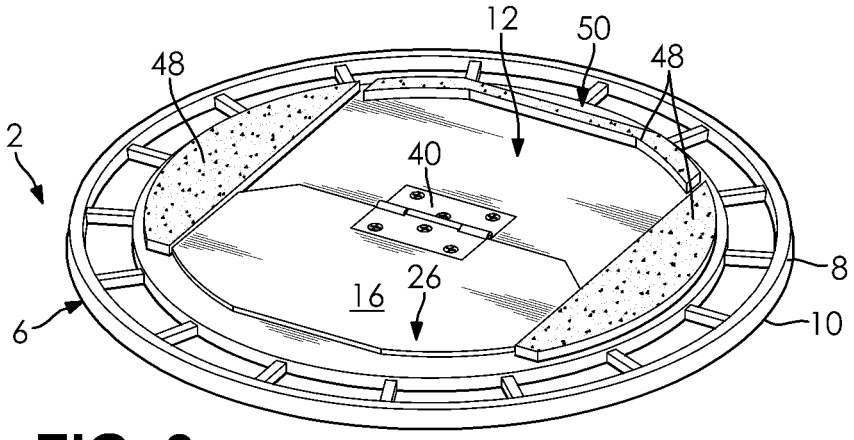
Figure 10:
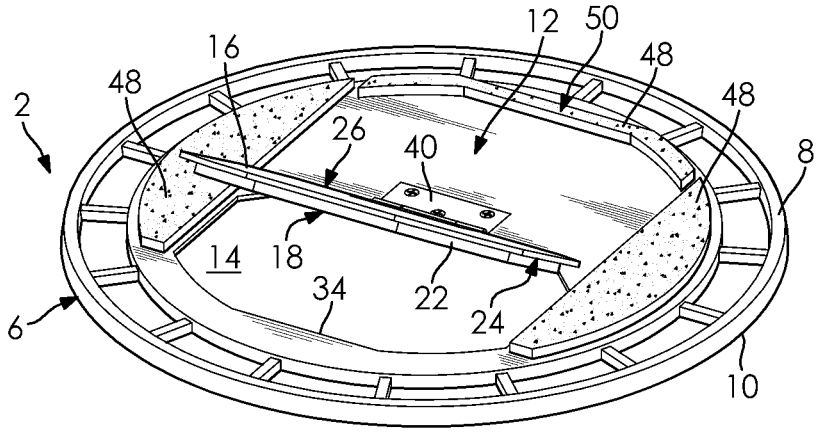
Figure 11:
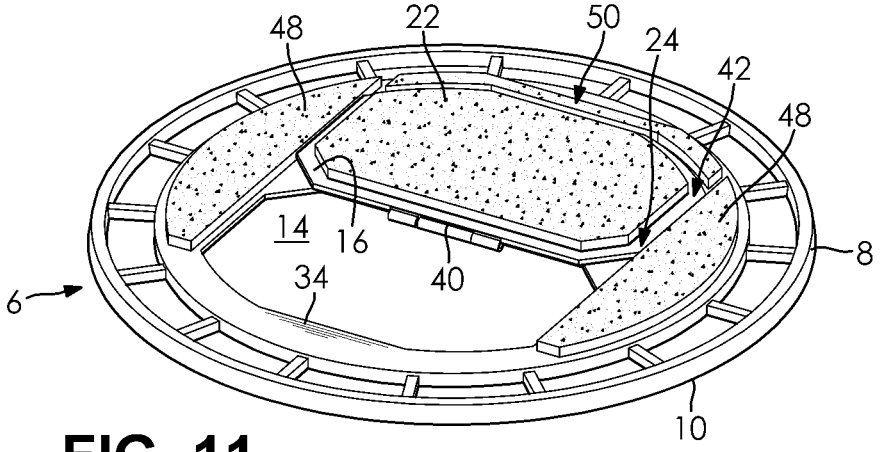
Figure 12:
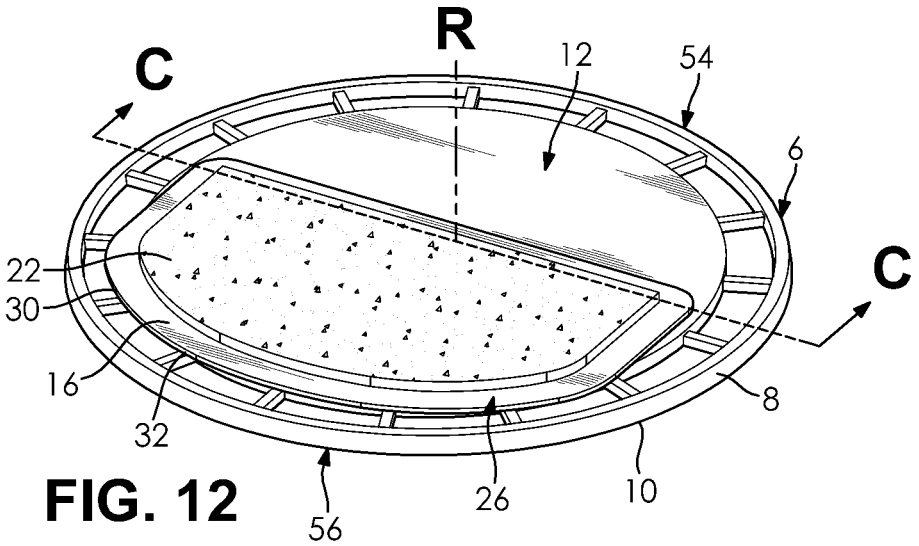
Figure 13:
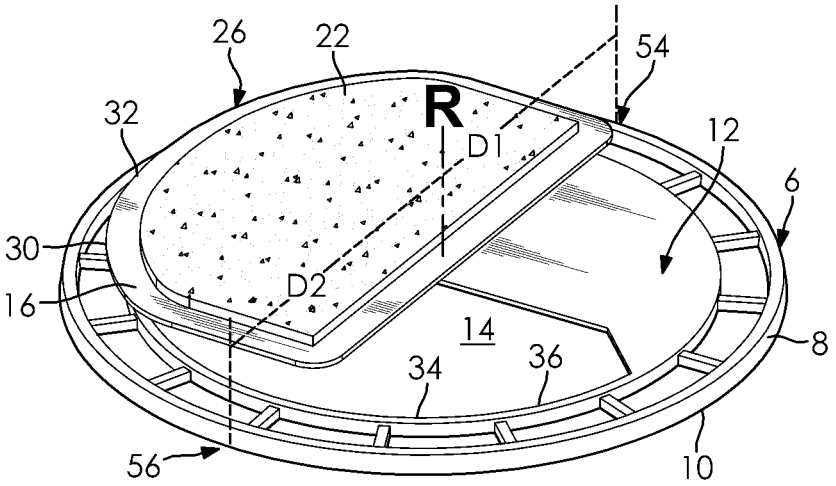
Figure 14:
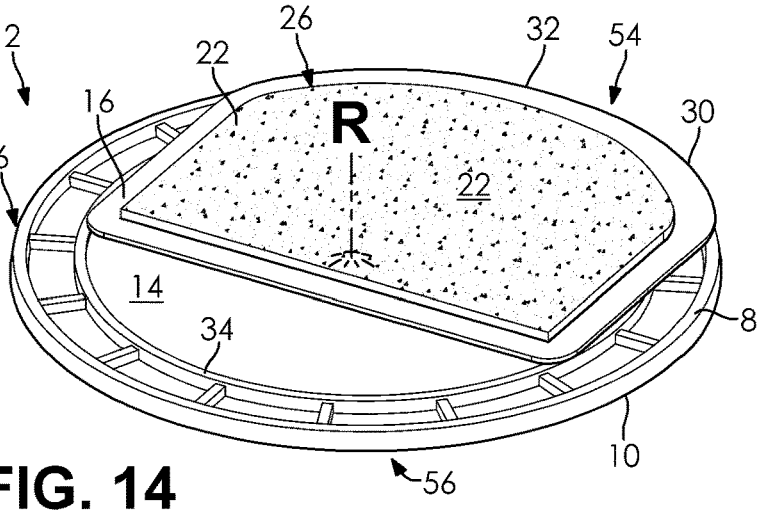
Figure 15:
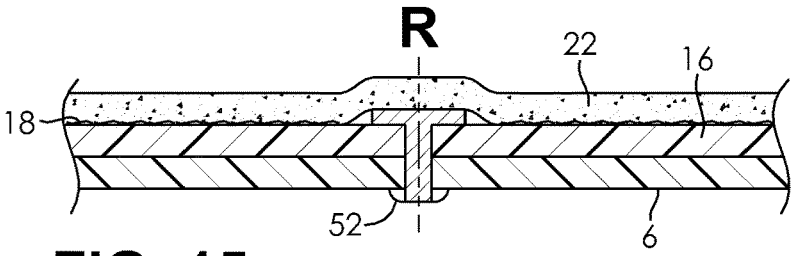
Figure 16:
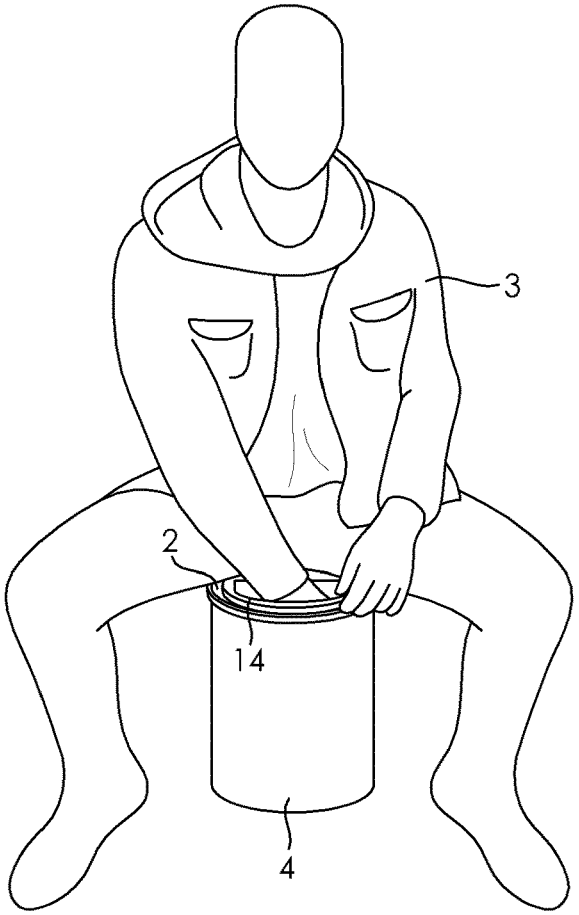

5, the hinge formed by cooperation of integrally molded portions of the lid and the door;

FIG. 7 is a top perspective view of the lid shown in FIG. 5, where the door is further illustrated elevated between the opened position and the closed position;

FIG. 8 is a top perspective view of the lid shown in FIGS. 5 and 7, where the door is illustrated in the fully opened position;

FIG. 9 is a top perspective view of a lid according to a further embodiment of the present disclosure, and further showing a movable door in a closed position and covering an opening of the lid;

FIG. 10 is a top perspective view of the lid shown in FIG. 9, where the door is illustrated elevated between the opened position and the closed position;

FIG. 11 is a top perspective view of the lid shown in FIGS. 9 and 10, where the door is illustrated in the fully open position;

FIG. 12 is a top perspective view of a lid according to an additional embodiment of the present disclosure, and further showing a rotatable door in a closed position and covering an opening of the lid;

FIG. 13 is a top perspective view of the lid shown in FIG. 12, where the door is illustrated rotated between the closed position and the opened position;

FIG. 14 is a top perspective view of the lid shown in FIG. 12, where the door is illustrated in the fully opened position;

FIG. 15 is a fragmentary, cross-sectional, front elevational view of the lid taken at section line C-C in FIG. 12, and further illustrating a fastener for rotatably attaching the door to the lid; and FIG. 16 is a top perspective view of a user sitting on the lid of the present disclosure, where the door is in the opened position, and the user is inserting a hand into the bucket to retrieve contents from the bucket.

DETAILED DESCRIPTION

The following detailed description and appended drawings describe and illustrate various embodiments of the invention. The description and drawings serve to enable one skilled in the art to make and use the invention and are not intended to limit the scope of the invention in any manner.

FIGS. 1-16 show various embodiments of a combination seat and bucket lid 2 according to the present disclosure. The bucket lid 2 permits a user 3 to access contents of a bucket 4 while seated, for example, as shown in FIG. 16. Although the lid 2 is illustrated herein as being attachable to a conventional five-or-six-gallon bucket 4, it should be appreciated that the lid 2 may also be configured to attach to any other suitable container, such as a tote, a cup, a box, etc., as desired.

With continued reference to FIGS. 1-16, the lid 2 may have a main body 6 with a lip 8. The lip 8 may be configured to receive or otherwise connect with a top of the bucket 4. The lip 8 surrounds the main body 6 of the lid 2 and defines an outermost perimeter 10 of the main body 6. Within the perimeter 10 of the main body 6 is a center area 12. An opening 14 is formed in the center area 12 of the main body 6.

A door 16 is moveably attached to the main body 6 and configured to selectively seal and unseal the opening 14. In particular embodiments, the door 16 may be attached to the center area 12 of the main body 6. The door 16 may be movable between an opened position (shown in FIGS. 4, 7-8, 10-11, 13-14, and 16) and a closed position (shown in FIGS. 1-3, 5, 9, and 12).

In the closed position, the door 16 is adapted to cover the opening 14 formed through the main body 6, and to protect the contents of the bucket 4 from the surrounding environment. In the opened position, the door 16 is configured to permit access to the contents of the bucket 4 by a user 3 reaching through the opening 14 while the user 3 is in a seated position, for example, as shown in FIG. 16. As used herein, and unless otherwise stated, the term "opened position" is defined as including both fully opened and partly opened positions of the door 16, and the term "closed position" is defined to be the fully closed position of the door 16.

As non-limiting examples, the bucket lid 2 and the associated door 16 may be formed from a suitable thermoplastic such as polypropylene or polyethylene, or a suitable metal such as aluminum or steel. It is contemplated that the bucket lid 2 and the door 16 may also be formed from wood or composite materials in certain examples. However, one of ordinary skill in the art may also select other suitable materials for the bucket lid 2 and door 16, within the scope of the present disclosure.

Advantageously, as shown in FIGS. 2-3,4, 7-8, and 10-14, the door 16 may have a first pad 22 affixed to the door 16 to support and provide comfort to the user 3 while in the seated position. The first pad 22 may have a suitable thickness that facilitates a cushioning of the user 3 when seated, for example, between about one tenth of an inch (1/10") and about one inch (1") in thickness. Other suitable thicknesses for the first pad 22 may also be selected by one of ordinary skill in the art.

As non-limiting examples, the first pad 22 may be formed from foam or sponge rubber material such as polyurethane or a polyester fiber. The material selected for the first pad 22 may provide both comfort and be resilient to minimize degradation with exposure to the environment. The first pad 22 may also be affixed to the door 16 with a thin adhesion layer 18 of a chemical adhesive, for example, an acrylic adhesive. The adhesion layer 18 may be provided as a full layer between the door 16 and the first pad 22, or by a matrix or pattern of adhesive beads between the door 16 and the first pad 22. Mechanical fastening means for affixing the first pad 22 to the door 16 are also contemplated. However, a skilled artisan may select any other suitable material for the adhesion layer 18 and the first pad 22, or other means for affixing the first pad 22 to the door 16, as desired.

Figure 4:
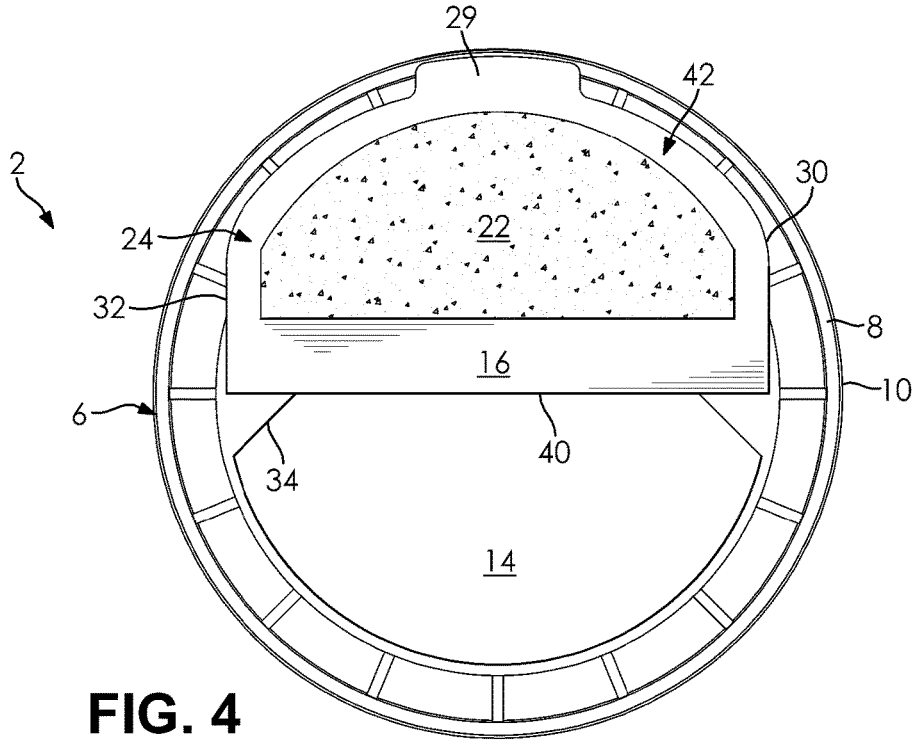
FIG. 4 is a top plan view of the lid shown in FIG. 1 with the door shown in an opened position and not covering the opening of the lid.

The door 16 may have a first side 24 and a second side 26, and the first pad 22 may be secured to either the first side 24 or the second side 26 of the door 16, as desired. In certain examples, as shown in FIGS. 4, 8, and 11, the first pad 22 may be attached to the first side 24 of the door 16 and configured to support the user 3 while in the seated position where the door 16 is in the opened position. In other examples, as shown in FIG. 14, the first pad 22 may be attached to the second side 26 of the door 16 and configured to support the user 3 while in the seated position where the door 16 is in the opened position. In either case, it should be appreciated that the selective moving of the door 16 to the opened position by the user allows the user 3 to access the contents of the bucket 4 through the opening 14 while also seated on the combination seat and bucket lid 2.

In further embodiments, as shown in FIGS. 1 and 4-8, the door 16 may have a grip tab 29 that facilitates the movement of the door 16 by the user 3. The grip tab 29 may extend outwardly from a primary body of the door 16. For example, the grip tab 29 may extend outwardly from a rim 30 of the door 16. In particular, the grip tab 16 may be disposed at a front portion of the rim 30 of the door 16, opposite a rear portion of the rim 30 of the door 16 that is movably attached to the main body 6 of the lid 2. Other locations and configurations for the grip tab 29 may also be selected, as desired.

Figure 1:
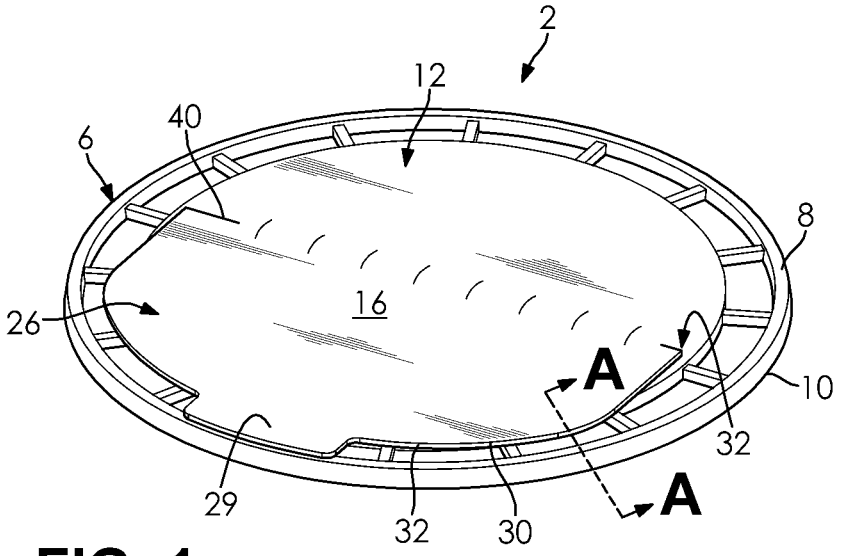
FIG. 1 is a top perspective view of a lid according to an embodiment of the present disclosure, and further showing a movable door in a closed position and covering an opening of the lid.
Figure 2:
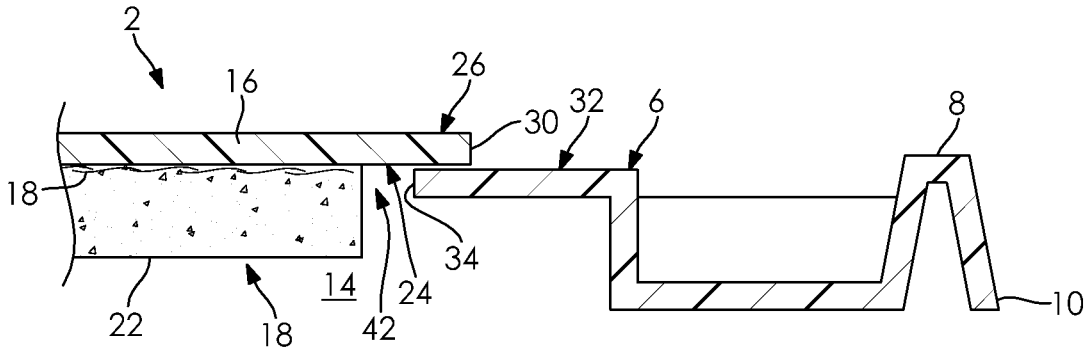
FIG. 2 is a fragmentary, cross-sectional, front elevational view of the lid taken at section line A-A in FIG. 1 according to one embodiment of the present disclosure, where a portion of the movable door abuts an upper surface of the lid adjacent the opening in the lid where the door is in the closed position.

In particular embodiments, as shown in FIG. 2, at least one of the first side 24 and the second side 26 of the door 16 may also have a surface area that is greater than an area of the opening 14. In particular, the greater surface area of the door 16 may result in the rim 30 of the door 16 extending laterally past an edge 34 of the opening 14, and in turn causing the rim 30 to rest upon an upper surface 32 of the main body 6 where the door 16 is in the closed position. It should also be appreciated that the relative arrangement of the rim 30 and the edge 34 of the opening 14 militates against the door 16 collapsing into an interior of the bucket 4 in operation.

Figure 3:
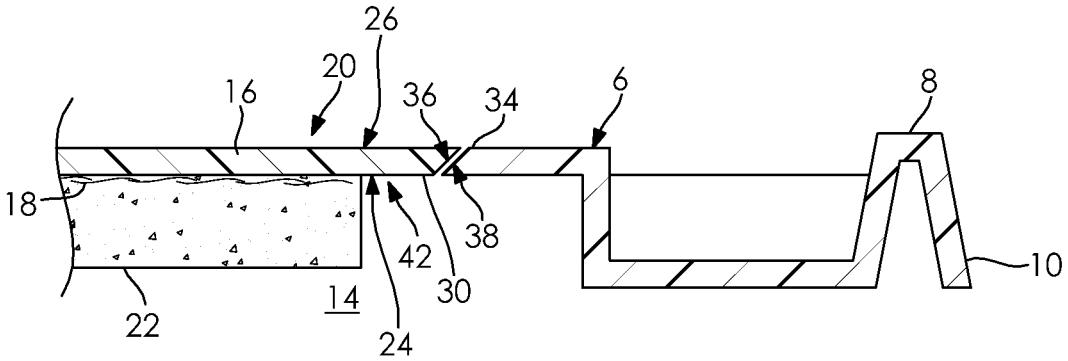
FIG. 3 is a fragmentary, cross-sectional, front elevational view of the lid taken at section line A-A in FIG. 1 according to another embodiment of the present disclosure, where an edge of the door is beveled and an edge of the lid defining the opening in the lid is beveled, and the beveled edges of the door and the opening of the lid abut where the door is in the closed position.

In further embodiments, as shown in FIG. 3, the edge 34 of the opening 14 and the rim 30 of the door 16 may each have complementary beveled surfaces 36, 38. The beveled surfaces 36, 38 of the rim 30 and the edge 34 also militate against the door 16 collapsing into the interior of the bucket 4 in operation. The beveled surfaces 36, 38 of the rim 30 and the edge 34 also allow the door 16 and the center area 12 of the main body 6 to be co-planar where the door 16 is in the closed position.

With reference to FIGS. 1-12, the door 16 may be movably attached to the lid 2 via a hinge 40. One skilled in the art may select any suitable type of the hinge 40, such as a living hinge (shown in FIGS. 1 and 4) and a butterfly hinge (shown in FIGS. 5 and 7-11), as non-limiting examples. The living hinge 40 may be a thin and flexible plastic that is co-formed with the lid 2 and the door 16, and which may be easily flexed to permit for the hinged movement of the door 16 in operation. The butterfly hinge 40 may be separately formed and affixed to each of the lid 2 and the door 16 with mechanical fasteners such as screws, bolts, or the like. Other suitable types of the hinge 40 are also contemplated and may be employed, as desired.

The door 16 is configured to alternate between the opened position where the front portion of the rim 30 is hingedly rotated upwardly and away from the opening 14, and the closed position where the front portion of the rim 30 is hingedly rotated downwardly and toward the opening 14. Where the first pad 22 is affixed to the first side 24 of the door 16, as shown in FIGS. 1-2, 5, and 9, the first pad 22 may be disposed in the opening 14 where the door 16 is hingedly rotated downwardly to the fully closed position. In such a configuration of the first pad 22, where the door 16 is hingedly rotated all the way to the fully opened position, as shown in FIGS. 4, 8, and 11, it should be appreciated that the second side 26 of the door 16 may then be disposed between the main body 6 of the lid 2 and the first pad 22.

With renewed reference to FIG. 2, a peripheral edge the first pad 22 may be spaced apart from an outermost edge of the rim 30 of the door 16 in order to fit within the opening 14, where the door 16 is hingedly rotated to the fully closed position. The spacing of the first pad 22 relative to the rim 30 of the door 16 defines a distance or gap area 42 of the door 16 between the peripheral edge of the first pad 22 and the outermost edge of the rim 30. The rim 30 of the door 16 may be adapted to abut the upper surface 32 of the main body 6 and cover the edge 34 of the opening 14 in the gap area 42. Likewise, a portion of the main body 6 adjacent the edge 34 of the opening 14 may abut the gap area 42 of the door 16 where the door 16 is in the closed position.

It should be appreciated that the first pad 22 is likewise configured to be disposed in the opening 14, where the door 16 is in the closed position. This configuration advantageously protects the first pad 22 from the environmental exposure and the elements where the door 16 is in the closed position. Additionally, the disposition of the first pad 22 within the interior of the bucket 4 where the door 16 is closed will provide the user 3 with a dry seat where the door 16 is subsequently opened, even if the lid 2 and bucket 4 have otherwise been exposed to a wet environment or conditions.

As shown in FIGS. 5 and 7-8, and in particular embodiments, the lid 2 may have a recess 41 that is formed in the center area 12 of the main body 6. The hinge 40 may be disposed within the recess 41 and attached to the center area 12 of the lid 2 at the recess 41. It should be appreciated that the disposing of the hinge 40 in the recess 41 may allow the door 16 to be oriented more parallel with the center area 12 of the lid 2 where the door 16 is in the closed position. This arrangement likewise permits for the provision of a more level seat for the user 3 where the lid 2 is in the opened position.

Figure 6:
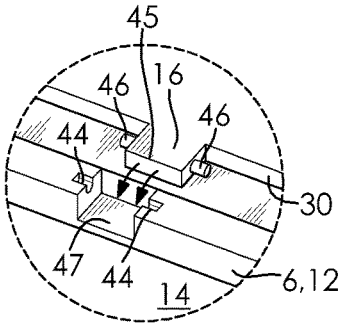
FIG. 6 is an enlarged, fragmentary, exploded, top perspective view of a hinge according to yet another embodiment of the present disclosure and taken at call-out B in FIG.

With reference to FIG. 6, and in alternative embodiments, the hinge 40 may be an integral hinge 40 defined by an integrally molded hinge portion of at least one of the main body 6 of the lid 2 and the door 16. For example, the main body 6 of the lid 2 may have at least one indentation 44 formed therein, which is configured to receive at least one hinge rod 46 of the door 16. The cooperation of the at least one indentation 44 with the at least one hinge rod 46 permits for a hinge-like attachment of the door 16 to the main body 6 of the lid 2. The at least one indentation 44 and the at least one hinge rod 46 may also be sized and shaped appropriate to provide a snap or friction-fit that permits the door 116 to be hingedly moved but otherwise secures the door 16 to the main body 6 of the lid 2.

The at least one hinge rod 46 may also be oriented substantially parallel with the rear edge of the rim 30 the door 16. In a particular embodiment, shown in FIG. 6, the door 16 may have two hinge rods 46 disposed on a hinge rod body 45 connected to the door 16, which are configured to be received by two indentations 44, where the indentations 44 are disposed on opposite sides of an aperture 47 formed in the main body 6 of the lid 2. Other integrally molded structures for forming the hinge 40 may also be selected by a skilled artisan within the scope of the present disclosure.

In another embodiment (not shown), the door 16 and the opening 14 may be sized and shaped appropriately to provide a snap or friction-fit between the door 16 and the opening 14 of the lid 2, where the door 16 is in the closed position. Additionally, in a further embodiment (not shown), the edge 34 of the opening 14 may have a sealing bead formed adjacent thereto. The sealing bead may be configured to form a fluid-tight seal between the door 16 and the opening 14 of the lid 2 where the door 16 is in the closed position. For example, the sealing bead may be provided by a ridge of a polymeric sealing material placed around at least one of the edge 34 of the opening 14 and the rim 30 of the door 16, in order to facilitate the formation of the fluid-tight seal in operation.

With reference to FIGS. 9-11, the lid 2 may be provided with at least one additional or second pad 48, which is configured to provide added comfort for the user 3 in the seated position. The second pad 48 may be formed from the same or different materials as the first pad 22, and may have the same or different thicknesses as the first pad 22, described hereinabove. The second pad 48 may also be affixed to the lid 2 with an adhesion layer (not shown), formed by the same or different chemical adhesives or mechanical fasteners as used for the first pad 22, also described hereinabove.

The second pad 48 may be disposed between the opening 14 and the lip 8 of the main body 6, for example. In certain embodiments, the second pad 48 may be disposed on a peripheral area 50 of the main body 6. The peripheral area 50 of the main body 6 may be located adjacent to the lip 8 and, more particularly, between the lip 8 and the central area 12 of the main body 6. The second pad 48 may also be absent from an area of the main body 6 where the second side 26 of the door 16 will normally abut the main body 6 where the door 16 is in the opened position. The abutting of the center area 12 of the main body 6 by the door 16 may allow an outer surface of the first pad 22 on the door 16 to be substantially coplanar with an exterior surface of the second 48 on the lid 2 where the door is in the fully opened position, for example, as shown in FIG. 11. It should be appreciated that the outer surface of the first pad 22 being substantially coplanar with the exterior surface on the second pad 48 may facilitate the formation of a more comfortable surface for the user 3 to sit upon, in operation.

In yet another embodiment, illustrated in FIGS. 12-15, the door 16 may be rotatably attached to main body 6 of the lid 2 about an axis of rotation (R) that is oriented transverse to a plane upon which the main body 6 of the lid 2 is disposed. In a particular embodiment, the axis of rotation (R) is orthogonal to the plane of the main body 6.

As shown in FIG. 14, the door 16 may be secured to the center area 12 of the lid 2 by a mechanical fastener 52 such as a screw, bolt, pin, rivet, or the like. Other suitable fastening arrangements may be chosen by one skilled in the art, including a nut and a bolt arrangement, swivels, or a ball and joint arrangement. It should be appreciated that a skilled artisan may choose from any other type of suitable fasteners permitting a rotating movement while securing the door 16 to the lid 2, as desired.

With reference to FIG. 15, the fastener 52 may be disposed underneath the first pad 22, which advantageously militates against the fastener 52 causing the user 3 discomfort in the seated position. Advantageously, the fastener 52 allows the door 16 to rotate around axis of rotation (R) oriented traverse to the bucket lid 2, thereby allowing the user 3 to selectively cover and uncover the opening 14 by rotation of the lid to either the closed position or the opened position, respectively. In particular, and in contrast to the hinged embodiment described hereinabove, the door 16 in this embodiment may be rotatable between the closed position, where the door 16 covers the opening 14, and the opened position, where the door 16 uncovers the opening 14.

With continued reference to FIGS. 12-15, the first pad 22 may be secured to the second side 26 of the door 16 where the door 16 is intended to be rotated to the closed and opened position about the axis of rotation (R). The first side 24 of the door 16 may therefore be disposed between the main body 6 and the first pad 22 where the door 16 is in both the opened position and the closed position.

Furthermore, as illustrated in FIGS. 12 and 14, the door 16 may be adapted to be disposed within entirely within the outermost perimeter 10 of the lid 2 where the door 16 is in the closed position (shown in FIG. 12), and also may be adapted to be disposed partly outside of the outermost perimeter 10 of the lid where the door 16 is in the opened position (shown in FIG. 14).

With continued reference to FIGS. 12-15, and in particular embodiments, the lid 2 of the main body 6 may have a first end 54 and a second end 56. The door 16 may be secured closer to the first end 54 than the second end 56. For example, as shown in FIG. 13, a distance D1, as measured from the axis of rotation (R) to the first end 54 of the lid 2, may be less than a distance D2, as measured from the axis of rotation (R) to the second end 56 of the lid 2. It should be appreciated that, where the door 16 is secured at the axis of rotation (R) being offset from an exact center of the lid 2, the door 16 may fit within the perimeter 10 of the lid 2 in the closed position (shown in FIG. 12), but a portion of the door 16 will be outside of the outermost perimeter 10 of the lid 2 in the opened position (shown in FIG. 14). Advantageously, this allows the first pad 22 to have a larger surface area than it might otherwise be able to have, which in turn provides a greater comfort to the user 3 in the seated position.

In operation, the user 3 may first attach the lid 2 to the bucket 4. In the embodiments shown in FIGS. 1-15, the user 3 may then move the door 16, either hingedly or by rotation about the axis of rotation (R), from the closed position to the opened position before sitting upon the lid 2. This allows the user 3 to access the contents of the bucket 4 while subsequently seated on at least one of the first pad 22 and the second pad 48. After the user 3 is finished using the bucket 4 as a seat, the user 3 may stand up from the bucket 4 and move the door 16 to the closed position. In the closed position, the door 16 operates to cover or seal the opening 14 in the lid 2 and protect the contents of the bucket 4 from the surrounding environment.

In a most particular example, the combination seat and bucket lid 2 of the present disclosure is used in the context of a baseball practice or game, where the most coveted seat in any dugout is the baseball bucket 4. The opening 14 in the bucket lid 2 therefore allows the user 3 such as a player or coach to access baseballs in the bucket 4 without the hassle of having to stand up and remove the lid 2 each time a ball is to be retrieved from the bucket 4. Other uses for the lid 2 are also contemplated and may include, as non-limiting examples, hunting, fishing, camping, chlorine tablet storage for pools, gardening purposes, construction, and other sports or athletic events.

Advantageously, the combination seat and bucket lid 2 of the present allows the user to access the contents of the bucket 4, while remaining in a seated position. The combination seat and bucket lid 2 also provides superior comfort for the user 3 relative to conventional unpadded bucket lids known in the art.

While certain representative embodiments and details have been shown for purposes of illustrating the invention, it will be apparent to those skilled in the art that various changes may be made without departing from the scope of the disclosure, which is further described in the following appended claims.

What is claimed is:

1. A bucket lid, comprising:

a main body having an opening formed therein; and a door selectively movably attached to the main body, the door having a first pad, the door movable between an opened position and a closed position, the door covering the opening in the closed position, the door disposed between the first pad and the main body in the opened position, the door selectively movably attached to the main body by a hinge, the main body having a center area with a recess, the center area circumscribed by a lip, and the hinge affixed to the recess of the main body.

2. The bucket lid of claim 1, wherein the hinge is one of a butterfly hinge, a living hinge, and at least one indentation adapted to receive at least one hinge rod.

3. The bucket lid of claim 1, wherein the first pad is disposed entirely within the opening where the door is in the closed position.

4. The bucket lid of claim 1, wherein the main body has an edge surrounding the opening, and a rim surrounding the door, and the first pad is spaced apart from the rim of the door forming a gap between the rim of the door and the first pad.

5. The bucket lid of claim 4, wherein the rim of the door and the edge of the main body surrounding the opening are beveled.

6. The bucket lid of claim 4, wherein the rim of the door has a first border, and the edge of opening has a second boarder, and the first boarder of the rim is greater than the second border of the edge.

7. The bucket lid of claim 6, wherein the edge of the main body abuts the door in the gap between the rim of the door and the first pad, where the door is in the closed position.

8. The bucket lid of claim 1, wherein a rim surrounds the door, and a grip tab extends outwardly from the rim of the door.

9. The bucket lid of claim 1, wherein the main body has a center area and a peripheral area, and both the center area and the peripheral area are circumscribed by a lip, the opening formed through the center area, and the peripheral area having at least one second pad.

10. The bucket lid of claim 9, wherein the second pad is disposed between the opening and the lip of the main body.

11. The bucket lid of claim 9, wherein the center area of the main body is configured to abut the second side of the door where the door is in the opened position.

12. The bucket lid of claim 1, wherein the main body has a center area, and the center area is circumscribed by a lip, and the door is disposed entirely within a lip of the lid where the door is in the open position and the closed position.

13. The bucket lid of claim 1, wherein the door is movably attached to the main body about an axis of rotation.

14. The bucket lid of claim 13, wherein the axis of rotation is defined by one of a pin, a bolt, a screw, a rivet, and a swivel.

15. The bucket lid of claim 13, wherein the main body has a center area, and the center area is circumscribed by a lip, and the door is disposed entirely within the lip of the lid where the door is in the closed position, and a portion of the door is disposed outside of the lip where the door is in the opened position.

16. The bucket lid of claim 13, wherein the door is disposed between the first pad and the main body where in the closed position.

17. A bucket lid, comprising:

a main body having an opening formed therein; and a door selectively hingedly attached to the main body, the door having a first side and a second side with a first pad disposed on the first side, the door movable between an opened position and a closed position, the door covering the opening and the first pad within the opening where the door is in the closed position, and the second side of the door disposed between the first pad and the main body where the door is in the opened position.

18. A bucket lid, comprising:

a main body having an opening formed therein; and a door selectively movably attached to the main body about an axis of rotation, the door having a first side and a second side with a first pad disposed on the second side, the door movable between an opened position and a closed position, the door covering the opening in the closed position, the first side of the door disposed between the first pad and the main body where the door is in the opened position and in the closed position, and wherein the door is disposed entirely within the lip of the lid where the door is in the closed position, and a portion of the door is disposed outside of the lip where the door is in the opened position.

* * * * *